US012313296B2

(12) United States Patent
Ohigashi et al.

(10) Patent No.: US 12,313,296 B2
(45) Date of Patent: May 27, 2025

(54) HEAT EXCHANGER AND WATER HEATER

(71) Applicant: NORITZ CORPORATION, Hyogo (JP)

(72) Inventors: Takeshi Ohigashi, Hyogo (JP); Shigeo Sugie, Hyogo (JP); Norihide Wada, Hyogo (JP); Kengo Horiuchi, Hyogo (JP); Naoya Shiotsu, Hyogo (JP)

(73) Assignee: NORTIZ CORPORATION, Hyogo (JP)

( * ) Notice: Subject to any disclaimer, the term of this patent is extended or adjusted under 35 U.S.C. 154(b) by 422 days.

(21) Appl. No.: 18/072,598

(22) Filed: Nov. 30, 2022

(65) Prior Publication Data

US 2023/0184460 A1 Jun. 15, 2023

(30) Foreign Application Priority Data

Dec. 13, 2021 (JP) ..... 2021-201714

(51) Int. Cl.

| | |
|---|---|
| ***F24H 1/14*** | (2022.01) |
| ***F24H 1/12*** | (2022.01) |
| ***F28D 1/047*** | (2006.01) |
| ***F28F 1/32*** | (2006.01) |

(52) U.S. Cl.

CPC ..... *F24H 1/124* (2013.01); *F28D 1/0477* (2013.01); *F28F 1/325* (2013.01)

(58) Field of Classification Search

CPC ..... F24H 1/124; F24H 9/139; F24H 9/1836; F24H 8/00; F24H 1/14; F28D 1/0408; F28D 1/0477; F28D 1/0478; F28D 1/047; F28F 1/32; F28F 1/325

See application file for complete search history.

(56) References Cited

U.S. PATENT DOCUMENTS

| | | | | |
|---|---|---|---|---|
| 11,624,526 B2 * | 4/2023 | Horiuchi | F28F 1/325 122/355 |
| 2013/0264037 A1 * | 10/2013 | Otsubo | F28F 9/0224 165/157 |
| 2020/0064020 A1 * | 2/2020 | Aoki | F24H 8/00 |
| 2021/0190374 A1 * | 6/2021 | Shiotsu | F24H 1/41 |

FOREIGN PATENT DOCUMENTS

| | | | |
|---|---|---|---|
| JP | 2021101131 | 7/2021 | |
| WO | WO-2020021932 A1 * | 1/2020 | F24H 1/107 |

* cited by examiner

*Primary Examiner* — Gregory A Wilson
(74) *Attorney, Agent, or Firm* — JCIPRNET

(57) ABSTRACT

A heat exchanger includes a case, a first and second heat exchanger disposed inside the case, a partition member disposed inside the case, and a duct. The case has a first side wall and a second side wall spaced apart from and facing each other in a first direction, a third side wall and a fourth side wall spaced apart from and facing each other in a second direction orthogonal to the first direction, and a bottom wall. A gas outlet communicating with an interior of the case is formed in the first side wall. The first heat exchanger is farther from the bottom wall than the second heat exchanger in a third direction orthogonal to the first and second directions. The second heat exchanger includes meandering heat transfer tubes meandering within a plane orthogonal to the first direction and overlapping along the first direction.

13 Claims, 10 Drawing Sheets

HEAT EXCHANGER AND WATER HEATER

CROSS-REFERENCE TO RELATED APPLICATIONS

This application claims the priority benefit of Japan Application No. 2021-201714, filed on Dec. 13, 2021. The entirety of the above-mentioned patent application is hereby incorporated by reference herein and made a part of this specification.

BACKGROUND

Technical Field

The disclosure relates to a heat exchanger and a water heater.

Related Art

Japanese Patent Laid-open No. 2021-101131 (Patent Document 1) describes a heat exchanger. The heat exchanger described in Patent Document 1 includes a housing, a plurality of meandering heat transfer tubes, a partition member, and a duct.

The housing has a first side wall, a second side wall, a third side wall, a fourth side wall, and a bottom wall. The first side wall and the second side wall are spaced apart from and face each other in a first direction. The third side wall and the fourth side wall are spaced apart from and face each other in a second direction. The second direction is a direction orthogonal to the first direction. The bottom wall is connected to a lower end of the first side wall, a lower end of the second side wall, a lower end of the third side wall and a lower end of the fourth side wall. A gas outlet is formed in the first side wall. The gas outlet communicates with the interior of the housing. A gas inlet is defined by an upper end of the first side wall, an upper end of the second side wall, an upper end of the third side wall and an upper end of the fourth side wall.

The plurality of meandering heat transfer tubes are disposed inside the housing. The meandering heat transfer tube meanders within a plane orthogonal to the first direction. The plurality of meandering heat transfer tubes overlap along the first direction. The plurality of meandering heat transfer tubes are divided into a first group and a second group. The meandering heat transfer tube belonging to the first group is closer to the first side wall than the meandering heat transfer tube belonging to the second group.

The partition member is disposed inside the housing. The partition member includes a first portion and a second portion. The second portion extends within a plane orthogonal to the first direction. The second portion is disposed between the first group and the second group. A lower end of the second portion is spaced apart from the bottom wall. An upper end of the second portion is farther from the bottom wall than the meandering heat transfer tube. The first portion extends from the upper end of the second portion toward the first side wall and is attached to the second side wall. A portion of the gas inlet is blocked by the first portion.

The duct is attached to the first side wall so as to be connected to the gas outlet. A combustion gas introduced from the gas inlet travels downward while exchanging heat with hot water flowing through the meandering heat transfer tube belonging to the second group. The combustion gas that has reached the bottom wall passes between the lower end of the second portion and the bottom wall before being turned back upward, and exchanges heat with hot water flowing through the meandering heat transfer tube belonging to the first group. After that, the combustion gas is exhausted through the gas outlet and the duct.

The heat exchanger described in Patent Document 1 is a secondary heat exchanger above which a primary heat exchanger is disposed. In the heat exchanger described in Patent Document 1, an end of the duct near the first side wall is above an end of the first portion near the first side wall. Hence, in the heat exchanger described in Patent Document 1, the end of the duct near the first side wall may be damaged by heat.

SUMMARY

A heat exchanger according to one aspect of the disclosure includes a case, a first heat exchanger and a second heat exchanger disposed inside the case, a partition member disposed inside the case, and a duct. The case has a first side wall and a second side wall spaced apart from and facing each other in a first direction, a third side wall and a fourth side wall spaced apart from and facing each other in a second direction orthogonal to the first direction, and a bottom wall. A gas outlet communicating with an interior of the case is formed in the first side wall. The first heat exchanger is farther from the bottom wall than the second heat exchanger in a third direction orthogonal to the first direction and the second direction. The second heat exchanger includes a plurality of meandering heat transfer tubes meandering within a plane orthogonal to the first direction and overlapping along the first direction. The plurality of meandering heat transfer tubes are divided into a first group near the first side wall and a second group near the second side wall in comparison to the first group. The partition member includes a first portion and a second portion. The first portion is disposed between the first group and the second group. The first portion includes, in the third direction, a first end being an end near the bottom wall, and a second end being an end opposite to the first end. The first end is spaced apart from the bottom wall. The second portion includes, in the first direction, a third end connected to the second end, and a fourth end being an end opposite to the third end and attached to the first side wall. The duct is attached to the first side wall so as to be connected to the gas outlet. A portion of an end of the duct near the first side wall that is farthest from the bottom wall in the third direction is closer to the bottom wall than the fourth end in the third direction.

DESCRIPTION OF THE EMBODIMENTS

Figure 1:
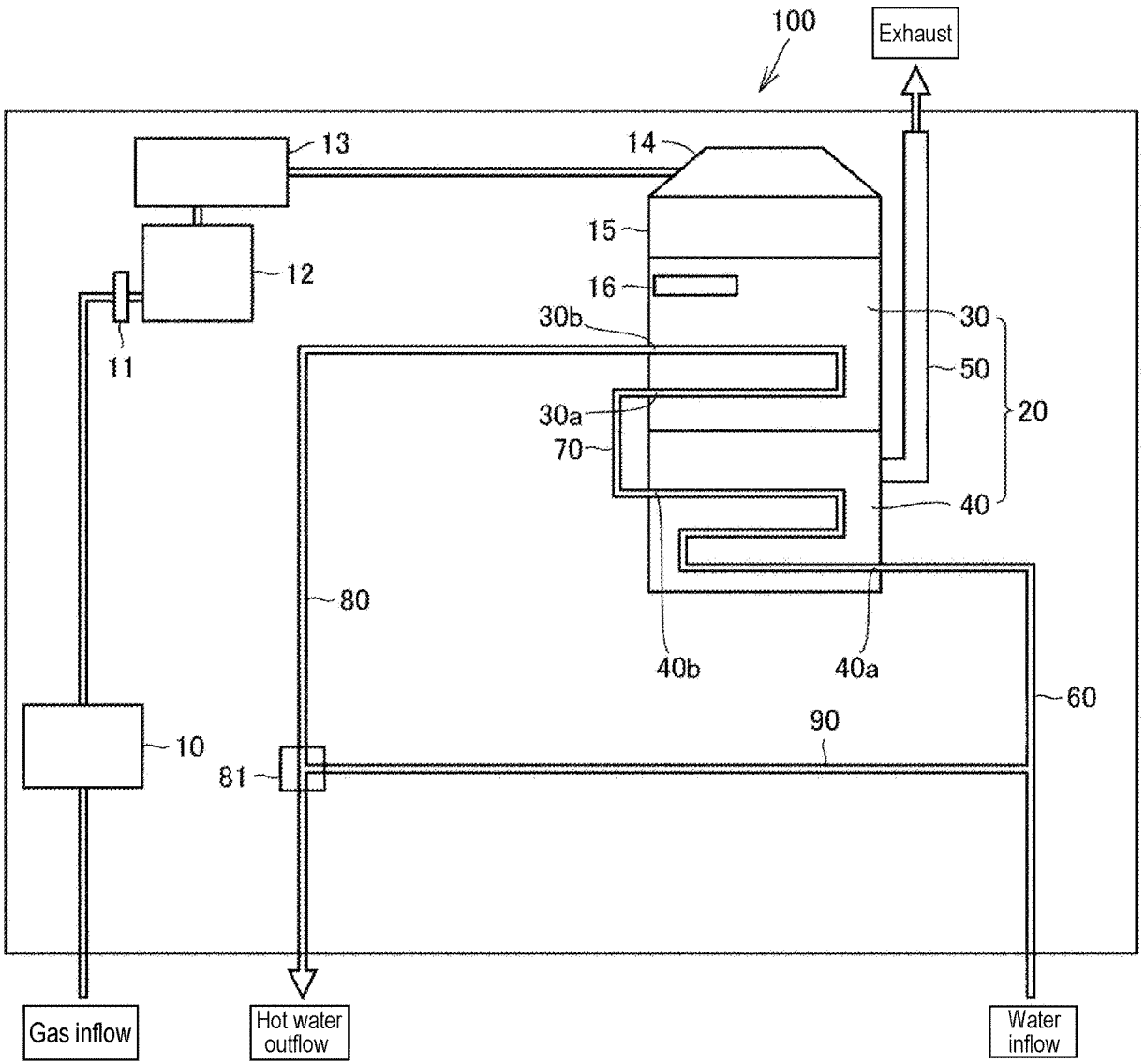
FIG. 1 is a schematic view of a water heater 100.

A heat exchanger according to one aspect of the disclosure includes a case, a first heat exchanger and a second heat exchanger disposed inside the case, a partition member disposed inside the case, and a duct. The case has a first side wall and a second side wall spaced apart from and facing each other in a first direction, a third side wall and a fourth side wall spaced apart from and facing each other in a second direction orthogonal to the first direction, and a bottom wall. A gas outlet communicating with an interior of the case is formed in the first side wall. The first heat exchanger is farther from the bottom wall than the second heat exchanger in a third direction orthogonal to the first direction and the second direction. The second heat exchanger includes a plurality of meandering heat transfer tubes meandering within a plane orthogonal to the first direction and overlapping along the first direction. The plurality of meandering heat transfer tubes are divided into a first group near the first side wall and a second group near the second side wall in comparison to the first group. The partition member includes a first portion and a second portion. The first portion is disposed between the first group and the second group. The first portion includes, in the third direction, a first end being an end near the bottom wall, and a second end being an end opposite to the first end. The first end is spaced apart from the bottom wall. The second portion includes, in the first direction, a third end connected to the second end, and a fourth end being an end opposite to the third end and attached to the first side wall. The duct is attached to the first side wall so as to be connected to the gas outlet. A portion of an end of the duct near the first side wall that is farthest from the bottom wall in the third direction is closer to the bottom wall than the fourth end in the third direction.

In the above heat exchanger, the first heat exchanger may include a plurality of straight heat transfer tubes extending along the second direction. The plurality of straight heat transfer tubes may be arranged side by side in a plurality of rows along the first direction. The fourth end may be farther from the bottom wall in the third direction than one of the plurality of rows that is closest to the bottom wall.

In the above heat exchanger, the second portion may include a third portion near the third end and a fourth portion near the fourth end. In a sectional view orthogonal to the second direction, an angle formed by an extension direction of the fourth portion and the first direction may be greater than an angle formed by an extension direction of the third portion and the first direction.

In the above heat exchanger, in a sectional view orthogonal to the second direction, an angle formed by an extension direction of the second portion and the first direction may increase from near the third end toward near the fourth end.

In the above heat exchanger, the first heat exchanger may include a plurality of straight heat transfer tubes extending along the second direction and a fin attached to the plurality of straight heat transfer tubes. The plurality of straight heat transfer tubes may be arranged side by side in a plurality of rows along the first direction. The fin may include a body extending within a plane orthogonal to the second direction, and a wall provided at an end of the body near the first side wall in the first direction and rising from the body along the second direction. A distance in the third direction between a lower end of the wall and the second portion may be less than a distance in the third direction between the second portion and one of the plurality of straight heat transfer tubes that belongs to one of the plurality of rows closest to the bottom wall and is closest to the first side wall.

In the above heat exchanger, each of the plurality of meandering heat transfer tubes may include a plurality of straight tube portions extending along the second direction and arranged side by side in a row along the third direction, a plurality of first connectors, and a plurality of second connectors. Each of the plurality of straight tube portions may have, in the second direction, a fifth end being an end near the third side wall, and a sixth end being an end opposite to the fifth end. The plurality of straight tube portions may include a first straight tube portion farthest from the bottom wall, a second straight tube portion closest to the bottom wall, and a plurality of third straight tube portions between the first straight tube portion and the second straight tube portion. Each of the plurality of first connectors may connect the sixth ends of two adjacent ones of the plurality of straight tube portions. A side of the first straight tube portion near the fifth end and a side of the second straight tube portion near the fifth end may be supported by the third side wall. Each of the plurality of second connectors may connect the fifth ends of two adjacent ones of the plurality of third straight tube portions. A position of the gas outlet in the third direction may be at, or may be farther from the bottom wall than, a position where the first straight tube portion of one of the plurality of meandering heat transfer tubes that is closest to the first side wall and one of the plurality of third straight tube portions that is farthest from the bottom wall are visible from the gas outlet.

The above heat exchanger may further include a support plate disposed inside the case. Each of the plurality of meandering heat transfer tubes may include a plurality of straight tube portions extending along the second direction and arranged side by side in a row along the third direction, a plurality of first connectors, and a plurality of second connectors. Each of the plurality of straight tube portions may have, in the second direction, a fifth end being an end near the third side wall, and a sixth end being an end opposite to the fifth end. The plurality of straight tube portions may include a first straight tube portion farthest from the bottom wall, a second straight tube portion closest to the bottom wall, and a plurality of third straight tube portions between the first straight tube portion and the second straight tube portion. Each of the plurality of first connectors may connect the sixth ends of two adjacent ones of the plurality of straight tube portions. A side of the first straight tube portion near the fifth end and a side of the second straight tube portion near the fifth end may be supported by the third side wall. Each of the plurality of second connectors may connect the fifth ends of two adjacent ones of the plurality of third straight tube portions. The support plate may support an end of each of the plurality of meandering heat transfer tubes near the fourth side wall. At least one of the first portion and the support plate may have a notch formed therein so that the first portion and the support plate are able to cross each other.

A water heater according to one aspect of the disclosure includes the above heat exchanger and a burner supplying a combustion gas to the heat exchanger.

According to the heat exchanger according to one aspect of the disclosure and the water heater according to one aspect of the disclosure, damage to a duct due to heat can be suppressed.

Embodiments of the disclosure will be described in detail with reference to the drawings. In the drawings below, the same or corresponding portions are denoted by the same reference numerals, and the description thereof will not be repeated.

First Embodiment

A water heater according to a first embodiment is described. The water heater according to the first embodiment is defined as a water heater 100.

<Configuration of Water Heater 100>

A configuration of the water heater 100 is described below.

FIG. 1 is a schematic view of the water heater 100. As shown in FIG. 1, the water heater 100 includes a gas valve 10, an orifice 11, a venturi 12, a blower 13, a chamber 14, a burner 15, a spark plug 16, a heat exchanger 20, a pipe 60, a pipe 70, a pipe 80, and a bypass pipe 90. The heat exchanger 20 includes a first heat exchanger 30, a second heat exchanger 40 and a duct 50. The first heat exchanger 30 is a primary heat exchanger. The second heat exchanger 40 is a secondary heat exchanger. A detailed configuration of the heat exchanger 20 will be described later.

By opening the gas valve 10, a fuel gas is supplied to the venturi 12 through the orifice 11. The fuel gas supplied to the venturi 12 is mixed with air in the venturi 12 (the fuel gas mixed with air is hereinafter referred to as mixed gas). The mixed gas is supplied to the burner 15 by the blower 13 via the chamber 14. The mixed gas supplied to the burner 15 is ignited and burned by sparking the spark plug 16. Accordingly, a combustion gas is generated in the burner 15.

The pipe 60 is connected at one end to a water supply. The pipe 60 is connected at the other end to a water inlet 40*a* of the second heat exchanger 40. The pipe 70 is connected at one end to a water outlet 40*b* of the second heat exchanger 40. The pipe 70 is connected at the other end to a water inlet 30*a* of the first heat exchanger 30. The pipe 80 is connected at one end to a water outlet 30*b* of the first heat exchanger 30. The pipe 80 is connected at the other end to a hot water tap (not shown). The bypass pipe 90 is connected at one end to the pipe 60 and at the other end to the pipe 80. Connection between the bypass pipe 90 and the pipe 80 is made by a three-way valve 81. The duct 50 is connected to the second heat exchanger 40.

<Detailed Configuration of Heat Exchanger 20>

The detailed configuration of the heat exchanger 20 is described below.

Figure 2:
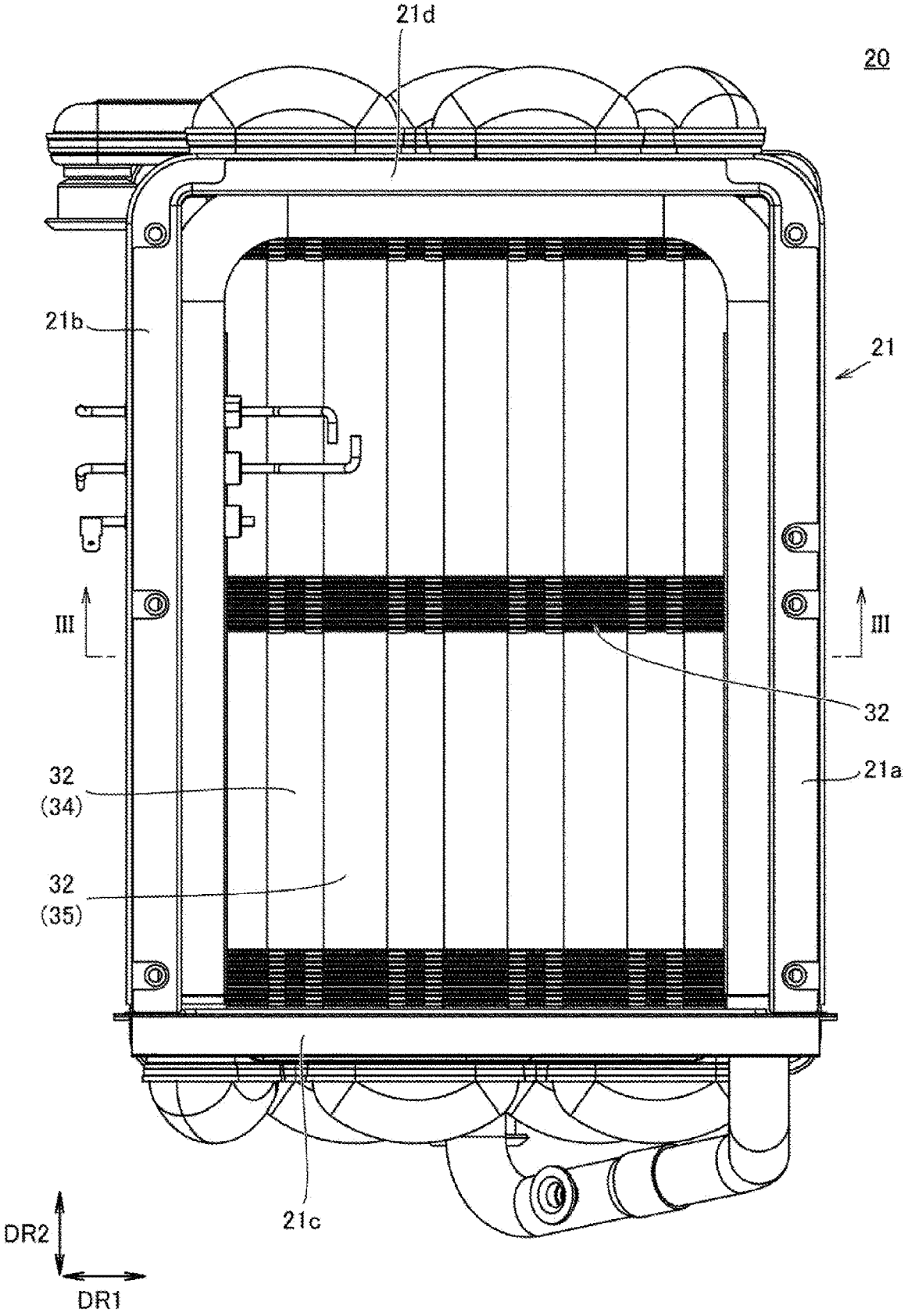
FIG. 2 is a plan view of a heat exchanger 20.
Figure 3:
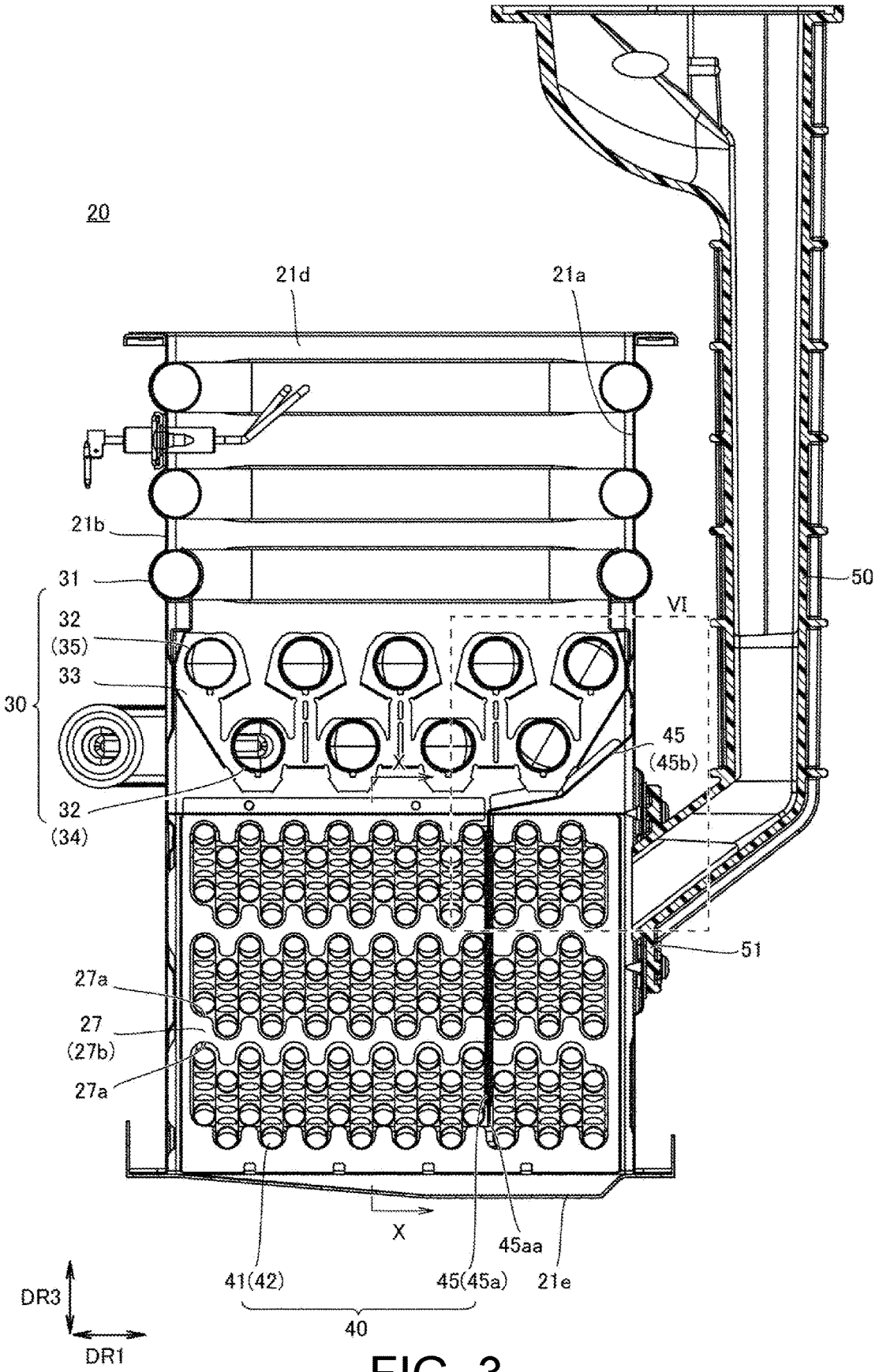
FIG. 3 is a sectional view along III-III in FIG. 2.
Figure 4:
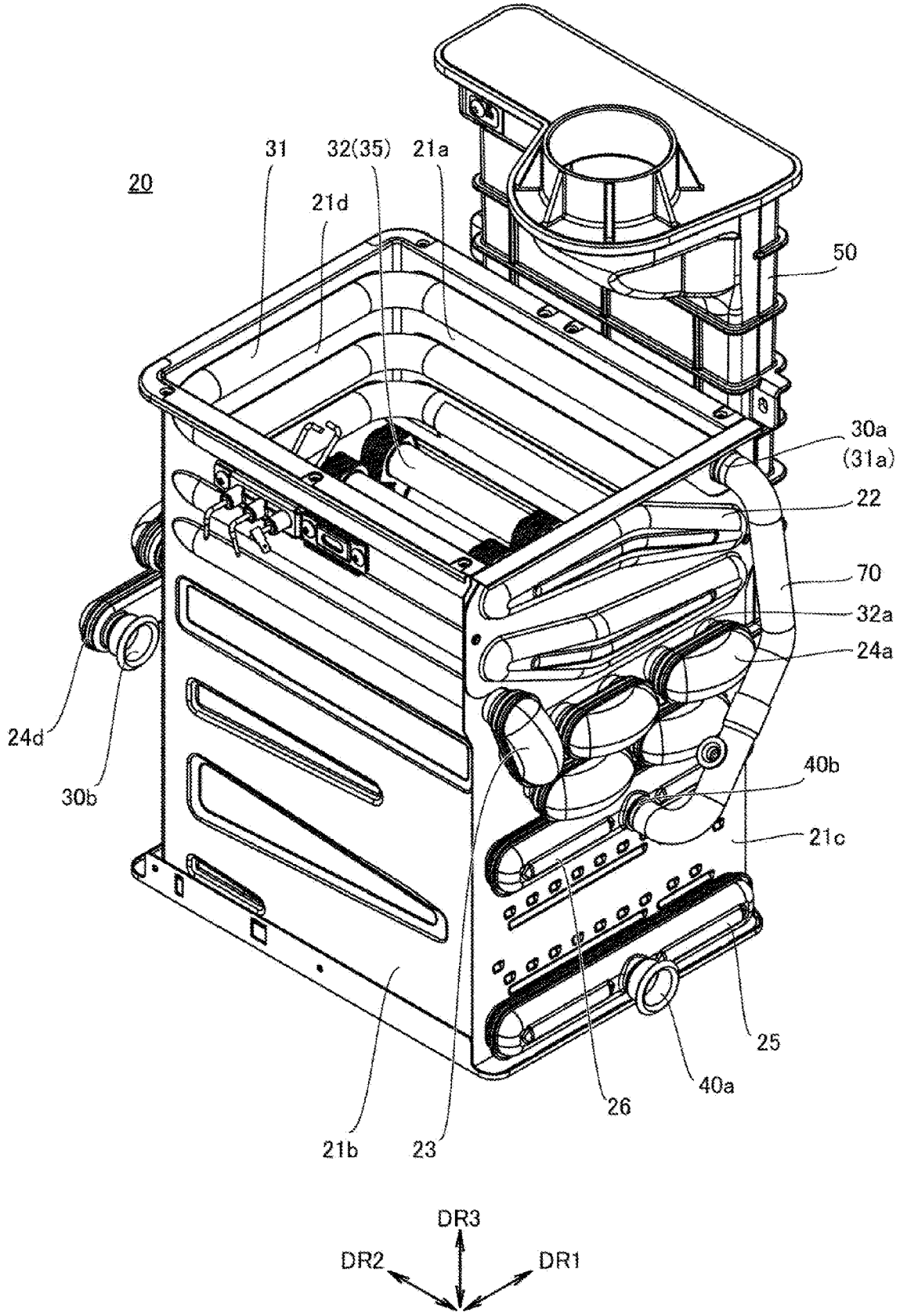
FIG. 4 is a first perspective view of the heat exchanger 20.
Figure 5:
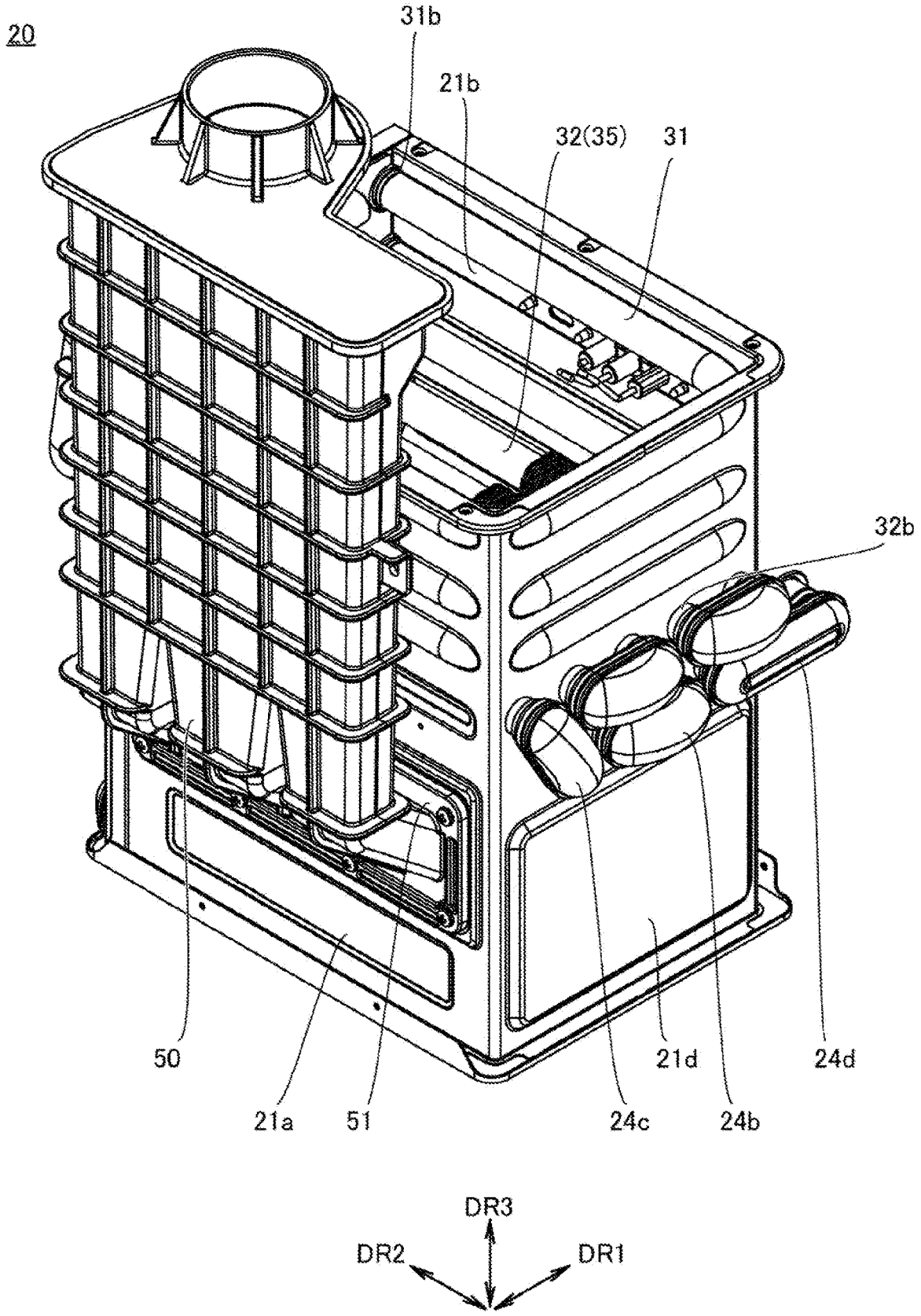
FIG. 5 is a second perspective view of the heat exchanger 20.
Figure 6:
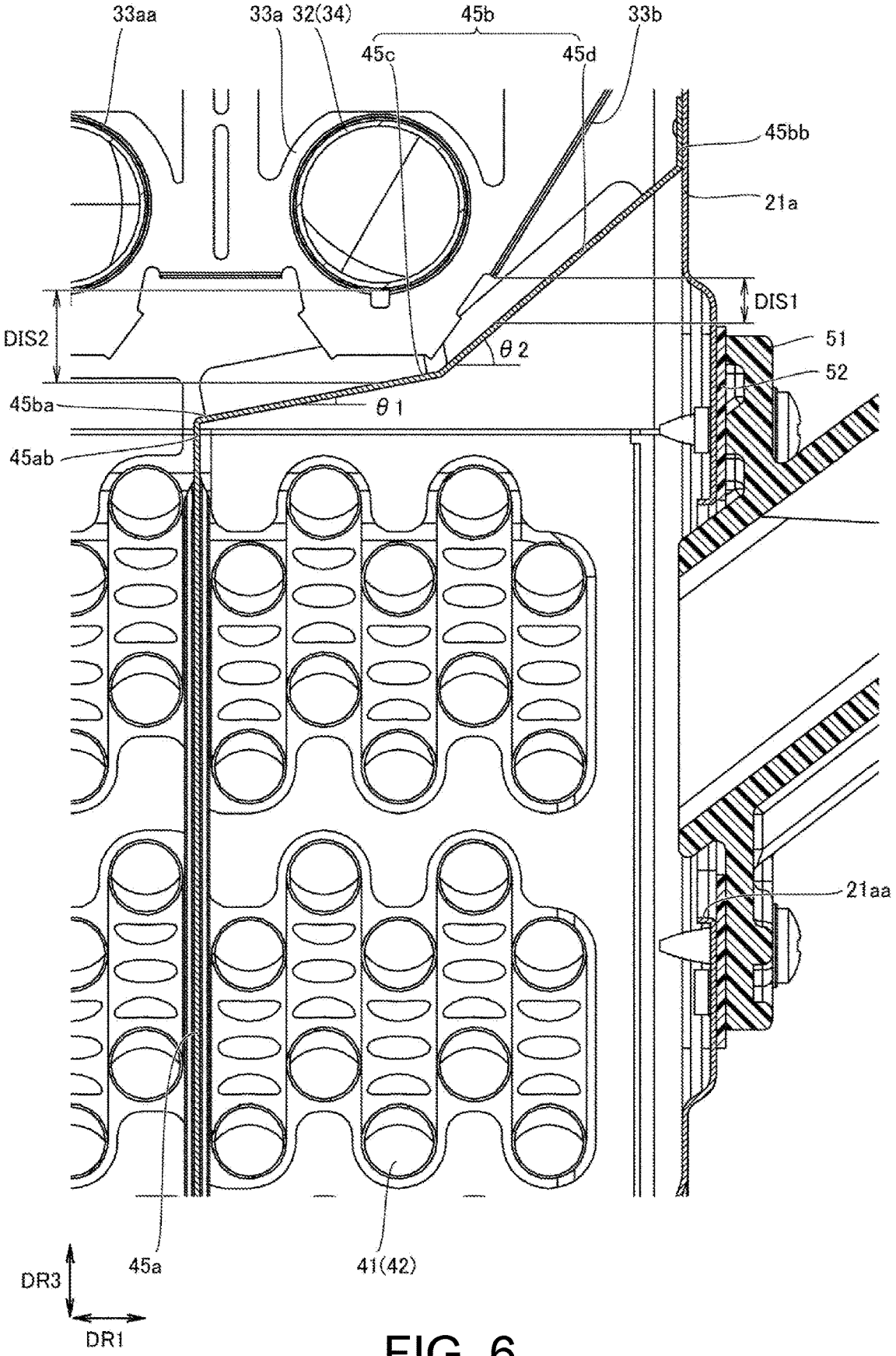
FIG. 6 is an enlarged view of VI in FIG. 3.
Figure 7:
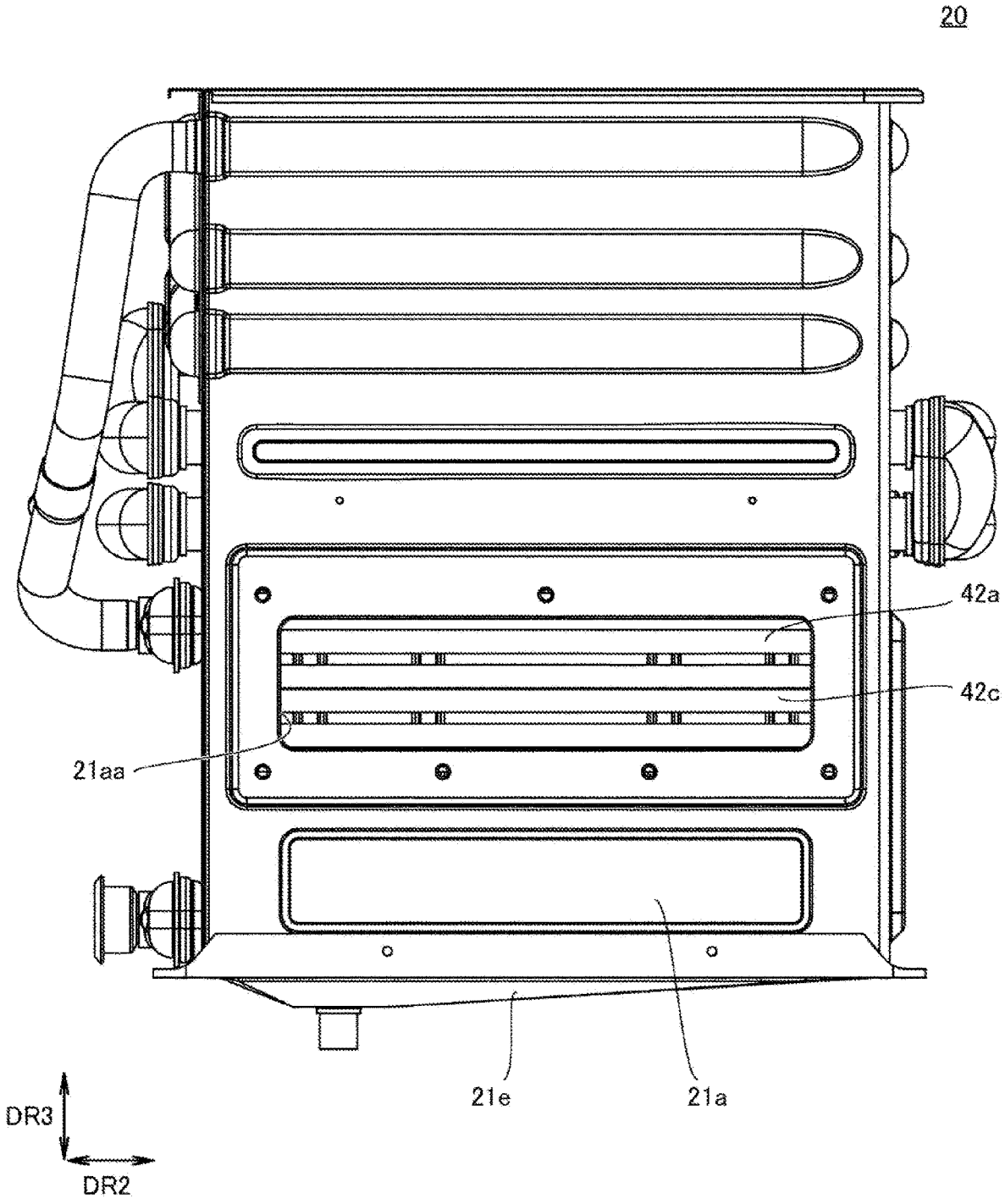
FIG. 7 is a side view of the heat exchanger 20.
Figure 8:
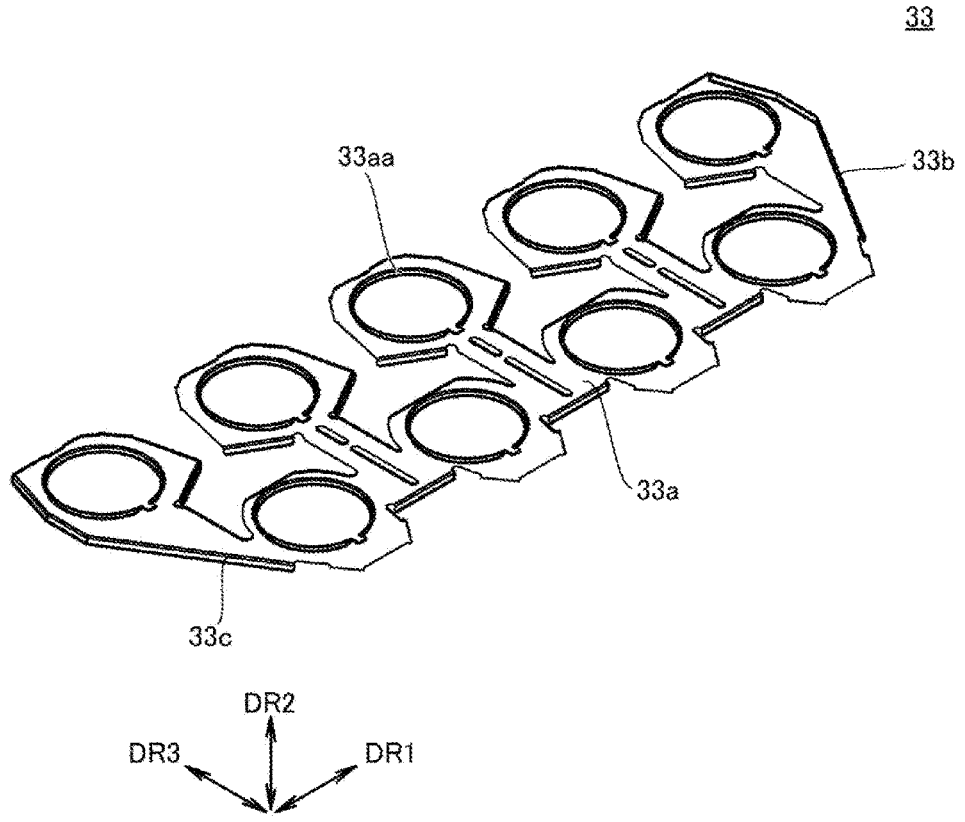
FIG. 8 is a perspective view of a fin 33.
Figure 9:
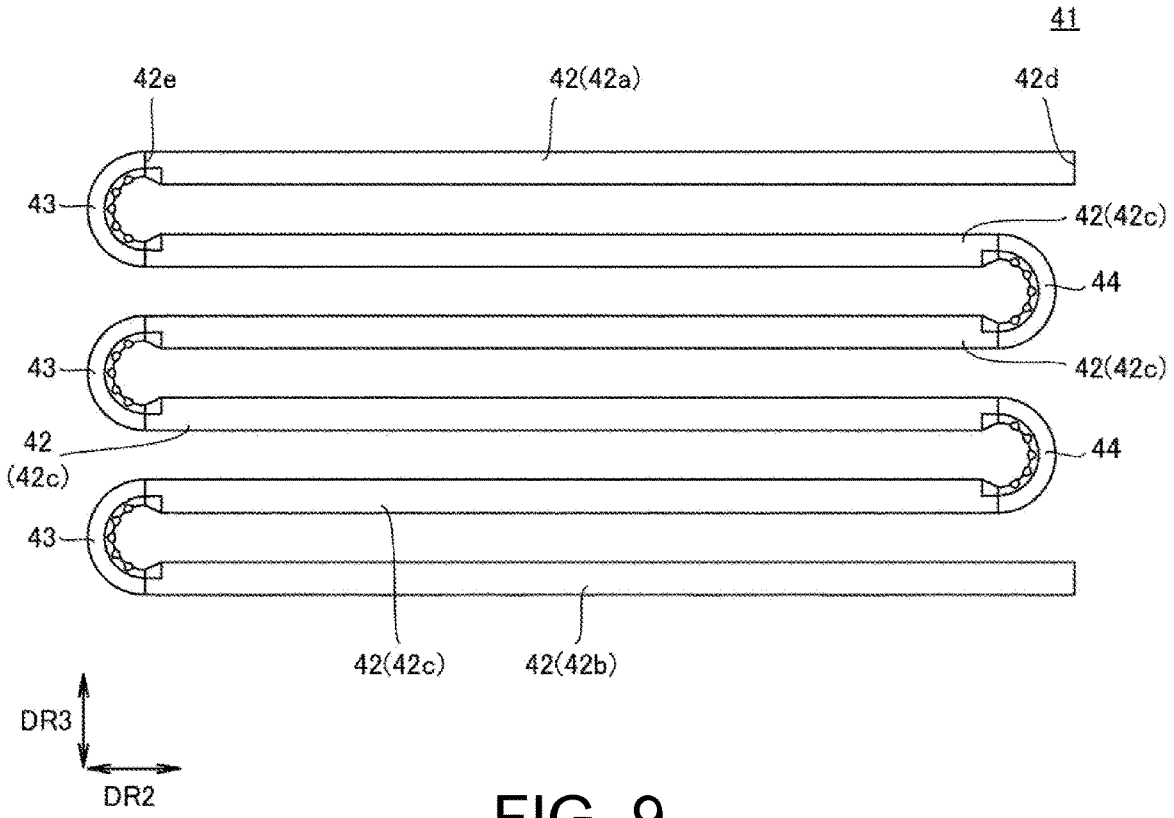
FIG. 9 is a side view of a meandering heat transfer tube 41.
Figure 10:
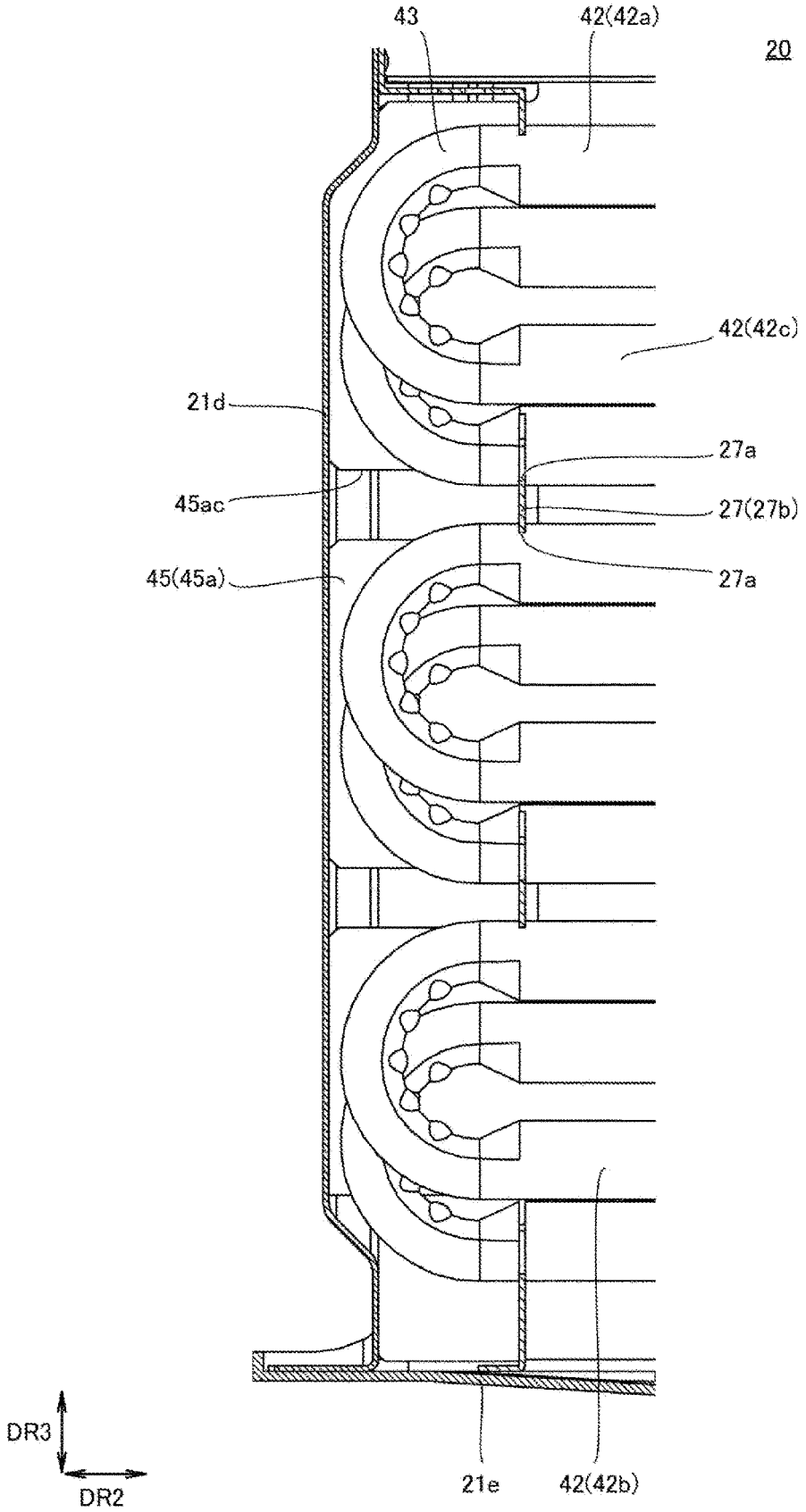
FIG. 10 is a sectional view along X-X in FIG. 3.

FIG. 2 is a plan view of the heat exchanger 20. In FIG. 2, the duct 50 is omitted from illustration. FIG. 3 is a sectional view along III-III in FIG. 2. FIG. 4 is a first perspective view of the heat exchanger 20. FIG. 5 is a second perspective view of the heat exchanger 20. FIG. 6 is an enlarged view of VI in FIG. 3. FIG. 7 is a side view of the heat exchanger 20. In FIG. 7, the duct 50 is omitted from illustration. FIG. 8 is a perspective view of a fin 33. FIG. 9 is a side view of a meandering heat transfer tube 41. FIG. 10 is a sectional view along X-X in FIG. 3. As shown in FIG. 2 to FIG. 10, the heat exchanger 20 includes a case 21. The first heat exchanger 30 and the second heat exchanger 40 are disposed inside the case 21. The case 21 has a first side wall 21*a*, a second side wall 21*b*, a third side wall 21*c*, a fourth side wall 21*d*, and a bottom wall 21*e*.

The first side wall 21*a* and the second side wall 21*b* are spaced apart from and face each other in a first direction DR1. The third side wall 21*c* and the fourth side wall 21*d* are spaced apart from and face each other in a second direction DR2. The second direction DR2 is orthogonal to the first direction DR1. The bottom wall 21*e* is connected to a lower end of the first side wall 21*a*, a lower end of the second side wall 21*b*, a lower end of the third side wall 21*c* and a lower end of the fourth side wall 21*d*. The first heat exchanger 30 is farther from the bottom wall 21*e* than the second heat exchanger 40 in a third direction DR3. The third direction DR3 is orthogonal to the first direction DR1 and the second direction DR2. Although not shown, the burner 15 is attached to an opening of the case 21 that is defined by an upper end of the first side wall 21*a*, an upper end of the second side wall 21*b*, an upper end of the third side wall 21*c*, and an upper end of the fourth side wall 21*d*. The combustion gas is ejected from the burner 15 toward the bottom wall 21*e*.

The first heat exchanger 30 includes a plurality of shell pipes 31, a plurality of straight heat transfer tubes 32 and a plurality of fins 33.

The shell pipe 31 has an end 31*a* and an end 31*b*. The end 31*a* and the end 31*b* are supported by the third side wall 21*c*. The shell pipe 31 extends from the end 31*a* toward the end 31*b* along an inner wall surface of the first side wall 21*a*, an inner wall surface of the fourth side wall 21*d*, and an inner wall surface of the second side wall 21*b*. That is, the shell pipe 31 is U-shaped. The plurality of shell pipes 31 are disposed overlapping with a space therebetween in the third direction DR3. The plurality of shell pipes 31 are farther from the bottom wall 21*e* than the plurality of straight heat transfer tubes 32.

The end 31*a* of the shell pipe 31 farthest from the bottom wall 21*e* is the water inlet 30*a* connected to the pipe 70. The end 31*b* of one shell pipe 31 is connected to the end 31*a* of another shell pipe 31 adjacent to the one shell pipe 31 by a channel 22 provided on an outer wall surface of the third side wall 21*c*. However, the end 31*b* of the shell pipe 31 closest to the bottom wall 21*e* is connected to an end 32*a* of a straight heat transfer tube 35 closest to the second side wall 21*b* by a header 23 attached to the outer wall surface of the third side wall 21*c*.

The straight heat transfer tube 32 extends along the second direction DR2. The straight heat transfer tube 32 has the end 32*a* and an end 32*b* in the second direction DR2. The end 32*b* is an end opposite to the end 32*a*. A side near the end 32*a* and a side near the end 32*b* of the straight heat transfer tube 32 are supported by the third side wall 21*c* and the fourth side wall 21*d*, respectively. The plurality of straight heat transfer tubes 32 are arranged side by side in a plurality of rows along the first direction DR1. In the example shown in FIG. 2 to FIG. 10, the plurality of straight heat transfer tubes 32 are arranged side by side in two rows along the first direction DR1. The straight heat transfer tube 32 belonging to the row among these two rows that is close to the bottom wall 21*e* is defined as a straight heat transfer tube 34. The straight heat transfer tube 32 belonging to the row among these two rows that is away from the bottom wall 21*e* is defined as the straight heat transfer tube 35.

The ends 32*a* of two straight heat transfer tubes 32 adjacent in the first direction DR1 are connected by a header 24*a* attached to the outer wall surface of the third side wall 21*c*. The ends 32*b* of two straight heat transfer tubes 32 adjacent in the first direction DR1 are connected by a header 24*b* attached to an outer wall surface of the fourth side wall 21*d*. However, the end 32*b* of the straight heat transfer tube 35 closest to the first side wall 21*a* is connected to the end 32*b* of the straight heat transfer tube 34 closest to the first side wall 21*a* by a header 24*c* attached to the outer wall surface of the fourth side wall 21*d*. The end 32*b* of the straight heat transfer tube 34 closest to the second side wall 21*b* is connected to a header 24*d* attached to the outer wall surface of the fourth side wall 21*d*. The water outlet 30*b* connected to the pipe 80 is provided in the header 24*d*.

The fin 33 is attached to the plurality of straight heat transfer tubes 32. The fin 33 includes a body 33*a*, a wall 33*b*, and a wall 33*c*. The body 33*a* extends within a plane orthogonal to the second direction DR2. The fin 33 is attached to the straight heat transfer tube 32 by passing the straight heat transfer tube 32 through a through hole 33*aa* formed in the body 33*a*. The wall 33*b* and the wall 33*c* are respectively located at an end near the first side wall 21*a* and an end near the second side wall 21*b* of the body 33*a* in the first direction DR1. The wall 33*b* and the wall 33*c* rise from the body 33*a* along the second direction DR2.

The second heat exchanger 40 includes a plurality of meandering heat transfer tubes 41. The meandering heat transfer tube 41 meanders within a plane orthogonal to the first direction DR1. More specifically, the meandering heat transfer tube 41 includes a plurality of straight tube portions 42, a plurality of first connectors 43 and a plurality of second connectors 44. The straight tube portion 42 extends along the second direction DR2. The plurality of straight tube portions 42 are spaced apart and arranged side by side in a row along the third direction DR3. The plurality of straight tube portions 42 include a first straight tube portion 42*a*, a second straight tube portion 42*b*, and a plurality of third straight tube portions 42*c*. The first straight tube portion 42*a* is the straight tube portion 42 farthest from the bottom wall 21*e*. The second straight tube portion 42*b* is the straight tube portion 42 closest to the bottom wall 21*e*. The third straight tube portion 42*c* is the straight tube portion 42 between the first straight tube portion 42*a* and the second straight tube portion 42*b*.

The straight tube portion 42 has a fifth end 42*d* and a sixth end 42*e* in the second direction DR2. The fifth end 42*d* is an end near the third side wall 21*c*. The sixth end 42*e* is an end opposite to the fifth end 42*d*. That is, the fifth end 42*d* is an end near the fourth side wall 21*d*. A side of the first straight tube portion 42*a* near the fifth end 42*d* is supported by the third side wall 21*c*. A side of the second straight tube portion 42*b* near the fifth end 42*d* is supported by the third side wall 21*c*. The first connector 43 connects the sixth ends 42*e* of two adjacent straight tube portions 42. The second connector 44 connects the fifth ends 42*d* of two adjacent third straight tube portions 42*c*.

The plurality of meandering heat transfer tubes 41 overlap along the first direction DR1. In the third direction DR3, the straight tube portion 42 of one meandering heat transfer tube 41 is between two adjacent straight tube portions 42 of other meandering heat transfer tubes 41 adjacent to the one meandering heat transfer tube 41 in the first direction DR1.

The fifth end 42*d* of the second straight tube portion 42*b* is connected to a header 25 attached to the outer wall surface of the third side wall 21*c*. The water inlet 40*a* connected to the pipe 60 is provided in the header 25. The fifth end 42*d* of the first straight tube portion 42*a* is connected to a header 26 attached to the outer wall surface of the third side wall 21*c*. The water outlet 40*b* connected to the pipe 70 is provided in the header 26.

The heat exchanger 20 further includes a partition member 45. The partition member 45 is disposed inside the case 21. The partition member 45 includes a first portion 45*a* and a second portion 45*b*. The plurality of meandering heat transfer tubes 41 are divided into a first group and a second group. The first group is a group of meandering heat transfer tubes 41 near the first side wall 21*a*. The second group is a group of meandering heat transfer tubes 41 near the second side wall 21*b* in comparison to the first group. The first portion 45*a* is disposed between the first group and the second group. The first portion 45*a*, for example, extends within a plane orthogonal to the first direction DR1. The number of meandering heat transfer tubes 41 belonging to the first group is preferably smaller than the number of meandering heat transfer tubes 41 belonging to the second group. From another point of view, a distance between the first portion 45*a* and the first side wall 21*a* is less than a distance between the first portion 45*a* and the second side wall 21*b*.

The first portion 45*a* has a first end 45*aa* and a second end 45*ab* in the third direction DR3. The first end 45*aa* is an end near the bottom wall 21*e*. The first end 45*aa* is spaced apart from the bottom wall 21*e*. The second end 45*ab* is an end opposite to the first end 45*aa*. The second end 45*ab* is farther from the bottom wall 21*e* than the meandering heat transfer tube 41 (first straight tube portion 42*a*). The second portion 45*b* has a third end 45*ba* and a fourth end 45*bb* in the first direction DR1. The third end 45*ba* is connected to the second end 45*ab*. The fourth end 45*bb* is an end opposite to the third end 45*ba*. The second portion 45*b* is attached to the inner wall surface of the first side wall 21*a* at the fourth end 45*bb*.

The second portion 45*b* is inclined with respect to the first direction DR1. More specifically, a position of the fourth end 45*bb* is farther from the bottom wall 21*e* than a position of the third end 45*ba*. The position of the fourth end 45*bb* is preferably farther from the bottom wall 21*e* than the straight heat transfer tube 34 in the third direction DR3. Since the position of the fourth end 45*bb* is farther from the bottom wall 21*e* than the position of the third end 45*ba*, condensed water dripped from the fin 33 onto the second portion 45*b* is less likely to flow toward near the duct 50 (near the first side wall 21*a*).

The second portion 45*b* may include a third portion 45*c* and a fourth portion 45*d*. The third portion 45*c* is near the third end 45*ba*. The fourth portion 45*d* is near the fourth end 45*bb* in comparison to the third portion 45*c*. An angle formed by an extension direction of the third portion 45*c* and the first direction DR1 and an angle formed by an extension direction of the fourth portion 45*d* and the first direction DR1 are respectively defined as an angle θ1 and an angle θ2. The angle θ2 is greater than the angle θ1. The angle θ1 is 0° or more. That is, the extension direction of the third portion 45*c* may be parallel to the first direction DR1.

A distance in the third direction DR3 between a lower end (end of the wall 33*b* near the bottom wall 21*e*) of the wall 33*b* and the second portion 45*b* is defined as a distance DIS1. A distance in the third direction DR3 between the straight heat transfer tube 34 closest to the first side wall 21*a* and the second portion 45*b* is defined as a distance DIS2. The distance DIS1 is preferably less than the distance DIS2.

A gas outlet 21*aa* is formed in the first side wall 21*a*. The gas outlet 21*aa* penetrates the first side wall 21*a* in a thickness direction and communicates with the interior of the case 21. The gas outlet 21*aa* has a rectangular shape whose longitudinal direction is along the second direction DR2 in a side view along the first direction DR1. In a side view along the first direction DR1, a position of the gas outlet 21*aa* is preferably farther from the bottom wall 21*e* than a position where the first straight tube portion 42*a* of the meandering heat transfer tube 41 that is closest to the first side wall 21*a* and the third straight tube portion 42*c* farthest from the bottom wall 21*e* are visible from the gas outlet 21*aa*. In a side view along the first direction DR1, the position of the gas outlet 21*aa* may be at the position where the first straight tube portion 42*a* of the meandering heat transfer tube 41 that is closest to the first side wall 21*a* and the third straight tube portion 42*c* farthest from the bottom wall 21*e* are visible from the gas outlet 21*aa*. However, an upper end of the gas outlet 21*aa* is closer to the bottom wall 21*e* than the fourth end 45*bb*.

The duct 50 is attached to an outer wall surface of the first side wall 21*a* so as to be connected to the gas outlet 21*aa*. An end of the duct 50 near the first side wall 21*a* is, for example, a flange 51. The duct 50 is attached at the flange 51 to the outer wall surface of the first side wall 21*a*. A seal member 52 is disposed between the outer wall surface of the first side wall 21*a* and the flange 51. The flange 51 is closer to the bottom wall 21*e* than the fourth end 45*bb* in the third direction DR3. More specifically, an upper end (that is, a portion of the flange 51 farthest from the bottom wall 21*e* in the third direction DR3) of the flange 51 is closer to the bottom wall 21*e* than the fourth end 45*bb* in the third direction DR3. The duct 50 is formed of, for example, a resin material.

The heat exchanger 20 may further include a support member 27. The support member 27 is disposed inside the case 21. The support member 27 extends within a plane orthogonal to the second direction DR2. A plurality of through holes 27*a* are formed in the support member 27. The plurality of through holes 27*a* are arranged side by side along the third direction DR3. By disposing an end of the meandering heat transfer tube 41 near the fourth side wall 21*d* inside the through hole 27*a*, the end is supported by a portion (defined as a support portion 27*b*) of the support member 27 between two adjacent through holes 27*a*.

Figure 11:
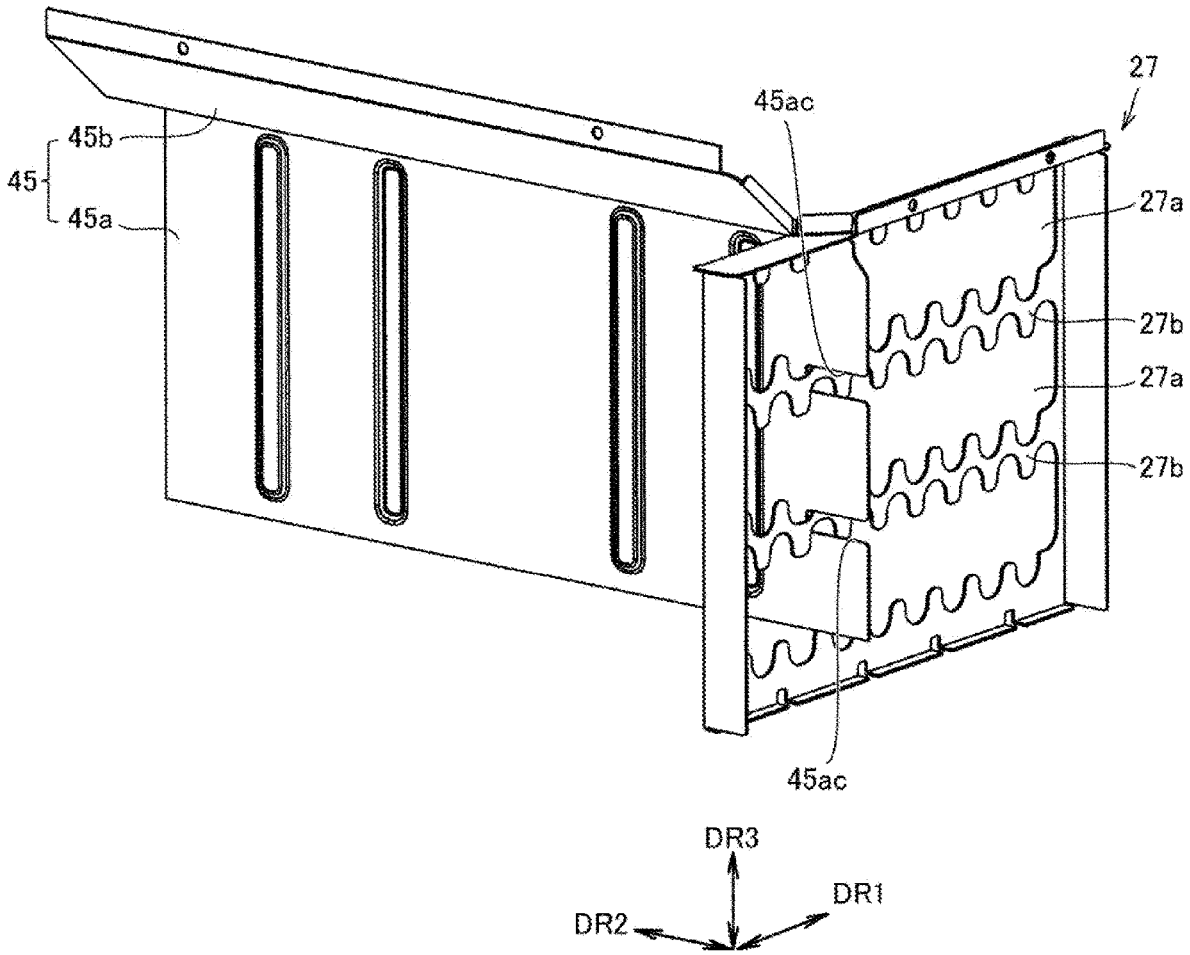
FIG. 11 is a perspective view showing a positional relationship between a support member 27 and a partition member 45.

FIG. 11 is a perspective view showing a positional relationship between the support member 27 and the partition member 45. As shown in FIG. 11, the support member 27 crosses the first portion 45*a*. More specifically, an end of the first portion 45*a* (partition member 45) near the fourth side wall 21*d* protrudes farther toward the fourth side wall 21*d* than the support member 27 (see FIG. 10). The end of the first portion 45*a* near the fourth side wall 21*d* is preferably in contact with the inner wall surface of the fourth side wall 21*d*. A notch 45*ac* is formed in the first portion 45*a* so that the first portion 45*a* is able to cross the support member 27. The notch 45*ac* extends along the second direction DR2 from the end of the first portion 45*a* near the fourth side wall 21*d*. The notch 45*ac* allows the support portion 27*b* to pass therethrough. In this example, a case of forming the notch 45*ac* in the first portion 45*a* has been described. However, it is also possible to form a notch in the support member 27 (more specifically, the support portion 27*b*) to enable the first portion 45*a* and the support member 27 to cross each other.

<Operation of Heat Exchanger 20>

The combustion gas ejected from the burner 15 toward the bottom wall 21*e* undergoes heat exchange in the first heat exchanger 30. More specifically, the combustion gas exchanges heat with hot water flowing through the plurality of straight heat transfer tubes 32.

The combustion gas that has passed through the first heat exchanger 30 undergoes heat exchange in the second heat exchanger 40. More specifically, firstly, the combustion gas passes between the first portion 45*a* and the second side wall 21*b* and exchanges heat with hot water flowing through the meandering heat transfer tube 41 belonging to the second group. Secondly, the combustion gas that has reached the bottom wall 21*e* passes between the first end 45*aa* and the bottom wall 21*e* and is turned back upward, and exchanges heat with hot water flowing through the meandering heat transfer tube 41 belonging to the first group. Since the combustion gas increases in flow velocity when passing between the first end 45*aa* and the bottom wall 21*e*, heat exchange efficiency of the second heat exchanger 40 is improved. Thirdly, the combustion gas that has exchanged heat with the hot water flowing through the meandering heat transfer tube 41 belonging to the first group is exhausted outside the heat exchanger 20 through the gas outlet 21*aa* and the duct 50.

<Effects of Heat Exchanger 20>

Effects of the heat exchanger 20 are described below.

The combustion gas from the burner 15 passes through the first heat exchanger 30 before reaching the second heat exchanger 40. Hence, a temperature in a portion of the first side wall 21*a* above the partition member 45 (away from the bottom wall 21*e*) is higher than a temperature in a portion of the first side wall 21*a* below the partition member 45 (close to the bottom wall 21*e*).

In the heat exchanger 20, the flange 51 is closer to the bottom wall 21*e* than the fourth end 45*bb*. That is, in the heat exchanger 20, the flange 51 is provided below the partition member 45 and is less likely to receive heat from the portion of the first side wall 21*a* that is raised in temperature. Hence, in the heat exchanger 20, damage to the flange 51 due to heat can be suppressed.

In the heat exchanger 20, in the case where the fourth end 45*bb* is farther from the bottom wall 21*e* than the straight heat transfer tube 34, a distance between the flange 51 and the portion of the first side wall 21*a* that is provided above the partition member 45 and raised in temperature can be ensured. Hence, in this case, damage to the flange 51 due to heat can further be suppressed.

In the case where the distance DIS1 is greater than the distance DIS2, the combustion gas is likely to enter between the lower end of the wall 33*b* and the second portion 45*b*. As a result, a temperature in a portion of the first side wall 21*a* in the vicinity of a portion where the flange 51 is attached is likely to rise. On the other hand, in the case where the distance DIS1 is less than the distance DIS2, the combustion gas is more likely to pass between the straight heat transfer tube 34 closest to the first side wall 21*a* and the second portion 45*b* than between the lower end of the wall 33*b* and the second portion 45*b*. Hence, by making the distance DIS1 less than the distance DIS2, damage to the flange 51 due to heat can further be suppressed.

In the case where the position of the gas outlet 21*aa* is farther from the bottom wall 21*e* than the position where the first straight tube portion 42*a* of the meandering heat transfer tube 41 that is closest to the first side wall 21*a* and the third straight tube portion 42*c* farthest from the bottom wall 21*e* are visible from the gas outlet 21*aa* in a side view along the first direction DR1, the combustion gas flows around the meandering heat transfer tube 41 belonging to the first group even at a position away from the bottom wall 21*e* before being exhausted from the gas outlet 21*aa*. Hence, in this case, the heat exchange efficiency of the heat exchanger 20 (second heat exchanger 40) can further be improved.

In the case where the end of the meandering heat transfer tube 41 near the fourth side wall 21*d* is supported by the support member 27, the meandering heat transfer tube 41 is supported not only on a side near the third side wall 21*c* but also on a side near the fourth side wall 21*d*. By forming a notch in either the first portion 45*a* or the support member 27 so that the first portion 45*a* and the support member 27 are able to cross each other, even if the support member 27 is disposed inside the case 21, an end of the partition member 45 near the fourth side wall 21*d* can be disposed close to the fourth side wall 21*d*. As a result, the combustion gas is less likely to take a shortcut between the partition member 45 and the fourth side wall 21*d* without passing around the meandering heat transfer tube 41 belonging to the second group. In this way, in the case where the heat exchanger 20 includes the support member 27, while support is provided from both near the third side wall 21*c* and near the fourth side wall 21*d* and deformation of the meandering heat transfer tube 41 is suppressed, heat conversion efficiency can be improved.

<Modifications>

The second portion 45*b* may not include the third portion 45*c* and the fourth portion 45*d*. From another point of view, an angle formed by an extension direction of the second portion 45*b* and the first direction DR1 may be constant. The angle formed by the extension direction of the second portion 45*b* and the first direction DR1 may increase from near the third end 45*ba* toward near the fourth end 45*bb*.

Although the embodiments of the disclosure have been described as above, the above embodiments can be modified in various ways. The scope of the disclosure is not limited to the above embodiments. The scope of the disclosure is defined by claims and is intended to include all modifications that come within the meaning and scope of the claims and any equivalents thereof.

The above embodiments may be applied in a heat exchanger and a water heater having a heat exchanger.

What is claimed is:

1. A heat exchanger, comprising:

a case;

a first heat exchanger and a second heat exchanger, disposed inside the case;

a partition member, disposed inside the case; and a duct, wherein the case has a first side wall and a second side wall spaced apart from and facing each other in a first direction, a third side wall and a fourth side wall spaced apart from and facing each other in a second direction orthogonal to the first direction, and a bottom wall;

a gas outlet communicating with an interior of the case is formed in the first side wall;

the first heat exchanger is farther from the bottom wall than the second heat exchanger in a third direction orthogonal to the first direction and the second direction;

the second heat exchanger comprises a plurality of meandering heat transfer tubes meandering within a plane orthogonal to the first direction and overlapping along the first direction;

the plurality of meandering heat transfer tubes are divided into a first group near the first side wall and a second group near the second side wall in comparison to the first group;

the partition member comprises a first portion and a second portion, wherein the first portion is disposed between the first group and the second group;

the first portion comprises, in the third direction, a first end being an end near the bottom wall, and a second end being an end opposite to the first end;

the first end is spaced apart from the bottom wall;

the second portion comprises, in the first direction, a third end connected to the second end, and a fourth end being an end opposite to the third end and attached to the first side wall;

the duct is attached to the first side wall so as to be connected to the gas outlet; and a portion of an end of the duct near the first side wall that is farthest from the bottom wall in the third direction is closer to the bottom wall than the fourth end in the third direction.

2. The heat exchanger according to claim 1, wherein the first heat exchanger comprises a plurality of straight heat transfer tubes extending along the second direction;

the plurality of straight heat transfer tubes are arranged side by side in a plurality of rows along the first direction; and the fourth end is farther from the bottom wall in the third direction than one of the plurality of rows that is closest to the bottom wall.

3. The heat exchanger according to claim 2, wherein the second portion comprises a third portion near the third end and a fourth portion near the fourth end; and an angle formed by an extension direction of the fourth portion and the first direction is greater than an angle formed by an extension direction of the third portion and the first direction in a sectional view orthogonal to the second direction.

4. The heat exchanger according to claim 2, wherein an angle formed by an extension direction of the second portion and the first direction increases from near the third end toward near the fourth end in a sectional view orthogonal to the second direction.

5. The heat exchanger according to claim 2, wherein each of the plurality of meandering heat transfer tubes comprises a plurality of straight tube portions extending along the second direction and arranged side by side in a row along the third direction, a plurality of first connectors, and a plurality of second connectors, wherein each of the plurality of straight tube portions has, in the second direction, a fifth end being an end near the third side wall, and a sixth end being an end opposite to the fifth end;

the plurality of straight tube portions comprise a first straight tube portion farthest from the bottom wall, a second straight tube portion closest to the bottom wall, and a plurality of third straight tube portions between the first straight tube portion and the second straight tube portion;

each of the plurality of first connectors connects the sixth ends of two adjacent ones of the plurality of straight tube portions;

a side of the first straight tube portion near the fifth end and a side of the second straight tube portion near the fifth end are supported by the third side wall;

each of the plurality of second connectors connects the fifth ends of two adjacent ones of the plurality of third straight tube portions; and a position of the gas outlet in the third direction is at, or is farther from the bottom wall than, a position where the first straight tube portion of one of the plurality of meandering heat transfer tubes that is closest to the first side wall and one of the plurality of third straight tube portions that is farthest from the bottom wall are visible from the gas outlet.

6. The heat exchanger according to claim 2, further comprising:

a support plate, disposed inside the case, wherein each of the plurality of meandering heat transfer tubes comprises a plurality of straight tube portions extending along the second direction and arranged side by side in a row along the third direction, a plurality of first connectors, and a plurality of second connectors, wherein each of the plurality of straight tube portions has, in the second direction, a fifth end being an end near the third side wall, and a sixth end being an end opposite to the fifth end;

the plurality of straight tube portions comprise a first straight tube portion farthest from the bottom wall, a second straight tube portion closest to the bottom wall, and a plurality of third straight tube portions between the first straight tube portion and the second straight tube portion;

each of the plurality of first connectors connects the sixth ends of two adjacent ones of the plurality of straight tube portions;

a side of the first straight tube portion near the fifth end and a side of the second straight tube portion near the fifth end are supported by the third side wall;

each of the plurality of second connectors connects the fifth ends of two adjacent ones of the plurality of third straight tube portions;

the support plate supports an end of each of the plurality of meandering heat transfer tubes near the fourth side wall; and at least one of the first portion and the support plate has a notch formed therein so that the first portion and the support plate are able to cross each other.

7. A water heater, comprising:

the heat exchanger according to claim 2; and a burner, supplying a combustion gas to the heat exchanger.

8. The heat exchanger according to claim 1, wherein the second portion comprises a third portion near the third end and a fourth portion near the fourth end; and an angle formed by an extension direction of the fourth portion and the first direction is greater than an angle formed by an extension direction of the third portion and the first direction in a sectional view orthogonal to the second direction.

9. The heat exchanger according to claim 1, wherein an angle formed by an extension direction of the second portion and the first direction increases from near the third end toward near the fourth end in a sectional view orthogonal to the second direction.

10. The heat exchanger according to claim 1, wherein the first heat exchanger comprises a plurality of straight heat transfer tubes extending along the second direction and a fin attached to the plurality of straight heat transfer tubes;

the plurality of straight heat transfer tubes are arranged side by side in a plurality of rows along the first direction;

the fin comprises a body extending within a plane orthogonal to the second direction, and a wall provided at an end of the body near the first side wall in the first direction and rising from the body along the second direction; and a distance in the third direction between a lower end of the wall and the second portion is less than a distance in the third direction between the second portion and one of the plurality of straight heat transfer tubes that belongs to one of the plurality of rows closest to the bottom wall and is closest to the first side wall.

11. The heat exchanger according to claim 1, wherein each of the plurality of meandering heat transfer tubes comprises a plurality of straight tube portions extending along the second direction and arranged side by side in a row along the third direction, a plurality of first connectors, and a plurality of second connectors, wherein each of the plurality of straight tube portions has, in the second direction, a fifth end being an end near the third side wall, and a sixth end being an end opposite to the fifth end;

the plurality of straight tube portions comprise a first straight tube portion farthest from the bottom wall, a second straight tube portion closest to the bottom wall, and a plurality of third straight tube portions between the first straight tube portion and the second straight tube portion;

each of the plurality of first connectors connects the sixth ends of two adjacent ones of the plurality of straight tube portions;

a side of the first straight tube portion near the fifth end and a side of the second straight tube portion near the fifth end are supported by the third side wall;

each of the plurality of second connectors connects the fifth ends of two adjacent ones of the plurality of third straight tube portions; and a position of the gas outlet in the third direction is at, or is farther from the bottom wall than, a position where the first straight tube portion of one of the plurality of meandering heat transfer tubes that is closest to the first side wall and one of the plurality of third straight tube portions that is farthest from the bottom wall are visible from the gas outlet.

12. The heat exchanger according to claim 1, further comprising:

a support plate, disposed inside the case, wherein each of the plurality of meandering heat transfer tubes comprises a plurality of straight tube portions extending along the second direction and arranged side by side in a row along the third direction, a plurality of first connectors, and a plurality of second connectors, wherein each of the plurality of straight tube portions has, in the second direction, a fifth end being an end near the third side wall, and a sixth end being an end opposite to the fifth end;

the plurality of straight tube portions comprise a first straight tube portion farthest from the bottom wall, a second straight tube portion closest to the bottom wall, and a plurality of third straight tube portions between the first straight tube portion and the second straight tube portion;

each of the plurality of first connectors connects the sixth ends of two adjacent ones of the plurality of straight tube portions;

a side of the first straight tube portion near the fifth end and a side of the second straight tube portion near the fifth end are supported by the third side wall;

each of the plurality of second connectors connects the fifth ends of two adjacent ones of the plurality of third straight tube portions;

the support plate supports an end of each of the plurality of meandering heat transfer tubes near the fourth side wall; and at least one of the first portion and the support plate has a notch formed therein so that the first portion and the support plate are able to cross each other.

13. A water heater, comprising:

the heat exchanger according to claim 1; and a burner, supplying a combustion gas to the heat exchanger.

* * * * *